United States Patent [19]

Zubarev et al.

[11] 4,071,093

[45] Jan. 31, 1978

[54] AIR PERCUSSION BORING MACHINE

[76] Inventors: Anatoly Ivanovich Zubarev, ulitsa Rozybakieva, 362, kv. 1; Lev Fedorovich Osipovsky, 5 mikroraion, 3, kv. 28; Stanislav Valeryanovich Shipov, ulitsa Dzerzhinskogo, 126, kv. 3, all of Alma-Ata, U.S.S.R.

[21] Appl. No.: 616,600

[22] Filed: Sept. 25, 1975

[51] Int. Cl.[2] ..... E21C 3/28

[52] U.S. Cl. ..... 173/105; 74/577 M

[58] Field of Search ..... 173/105–108, 173/163; 91/177; 74/577 M, 577 R

[56] References Cited

U.S. PATENT DOCUMENTS

| | | | |
|---|---|---|---|
| 2,043,352 | 6/1936 | Hulshizer | 74/577 M |
| 2,457,969 | 1/1949 | Anderson | 173/107 |
| 2,512,232 | 6/1950 | Haut | 74/577 M |
| 3,433,329 | 3/1969 | Koudelka | 74/577 R |
| 3,802,518 | 4/1974 | Albert | 173/163 X |

*Primary Examiner*—Ernest R. Purser
*Assistant Examiner*—William F. Pate, III
*Attorney, Agent, or Firm*—Lackenbach, Lilling & Siegel

[57] ABSTRACT

An air percussion boring machine comprising a percussion means, a front head with a boring tool holder, a rear head with a hole mouth washer and a boring tool rotation mechanism synchronized with the percussion means. The boring tool rotation mechanism is provided with a stator with blades secured on its internal surface at an equal distance from each other. Installed inside the stator is a rotor with blades whose number is equal to the number of stator blades. Arranged in the rotor cavity is a sleeve wherein pawls are hinged, the pawls having means for pressing the pawls to a ratchet coupled to a tail piece of the boring tool for rotating it. The pawls in each pair are coupled to each other and are used to rotate the ratchet clockwise and counterclockwise. The means for pressing the pawls to the ratchet is made in the form of air power cylinders with pistons contacting the pawls. A compressed air source is in communication with the air power cylinders of the pawls for rotating the ratchet in one direction and is set in mesh with the ratchet, while the air power cylinders of the other pawls are in communication with the atmosphere, thus dropping them out of meshing with the ratchet.

4 Claims, 6 Drawing Figures

AIR PERCUSSION BORING MACHINE

The present invention relates to air percussion boring machines with a self-contained boring tool rotation, is intended for drilling holes and deep wells for developing ore deposits, driving tunnels, carrying out construction works and so on.

There is known a percussion boring machine with a self-contained boring tool rotation, which comprises rear and front heads between which percussion and rotation mechanisms and air distribution means are arranged.

A percussion mechanism comprises a housing with an internal cylindrical chamber accommodating an air distribution means and a percussion piston. The percussion piston is a slide valve which distributes in its travel the compressed air supplied from a pipe line in turn to operating and idle chambers of the percussion and rotation mechanisms. Under the effect of the compressed air the percussion piston reciprocates and delivers at the end of its power stroke impacts to the tail piece of the boring tool.

Installed on the front head with a thread and lock is a boring tool holder with a central hole for a tail piece and a slot for a lug of the tail piece of the boring tool to prevent the tail piece from dropping out during the operation of the boring machine.

The rotation mechanism is installed between the percussion means and the front head and comprises a cylinder perpendicular to the longitudinal axis of the boring machine, said cylinder being closed with threaded plugs at its ends. Installed inside the internal cavity of the cylinder is a piston having a slot in the bottom portion, said piston dividing the cylinder into idle and operating stroke chambers. Compressed air is fed in turn to these chambers by corresponding channels from the idle and operating stroke chambers of the percussion mechanism, thus reciprocating said piston and driving a lever inserted into the slot of the piston said lever being made as a whole unit with the ratchet. The ratchet is in cooperation with the spring-loaded pawls located in the sleeve which oscillatory motions of the ratchet converts into an intermittent rotary motion imparted to the tail piece of the boring tool. The rotation mechanism of the known boring machine has a substantial diaadvantage which consists of the fact that pawls are pressed to the ratchet by springs which are the most wearable of parts. In addition, the rotation mechanism does not permit a reverse rotation of the boring tool, thus reducing the efficiency in sinking-hoisting operations when drilling deep wells since when boring deep wells without a reverse rotation of the boring tool the feeding and disassembling of the boring string of bars consume more than 30% of the operating time. It should be noted that these laborious operations are carried out by hand and without a reverse rotation of the boring tool it is impossible to mechanize them. In addition, the compressed air supplied to the rotation mechanism from the percussion mechanism chambers does not provide a rhythmic operation of the percussion piston while a considerable length of the air pressure channels for feeding the rotation mechanism chambers does not provide synchronous operation with the percussion mechanism.

Said disadvantages reduce the stability of the boring machine in operation and the efficiency of the boring work. This also causes a reduction in the efficiency of the boring machine.

It is an object of the present invention to increase the efficiency of boring operations.

It is another object of the present invention to provide a boring machine having a rotation mechanism operation stable and synchronous with the percussion means.

It is still another object of the present invention to raise the reliability of the rotation mechanism in operation.

It is a further object of the present invention to increase the operation efficiency of the boring machine.

These and other objects are accomplished by providing an air percussion boring machine with a self-contained boring tool rotation mechanism, comprising a percussion means having a cylindrical housing whose chamber accommodates a rear head with an air distribution means and a percussion piston reciprocating under the effect of compressed air and delivering impacts at the end of the power stroke to the tail piece of the boring tool, a front head installed coaxially with respect to the percussion piston and whereon the boring tool holder is fastened with a central hole for the tail piece of the boring tool, a mechanism for rotation of the boring tool, which is installed in the front portion of the boring machine, made in the form of a stator with blades secured on its internal surface equidistant from each other, said blades being provided with sealing members at the ends, a rotor installed inside the stator and provided with blades whose number is equal to the number of stator blades a sleeve installed inside the rotor wherein pawls are hinged with a means for pressing pawls to a ratchet which is installed in the front head and coupled to the tail piece of the boring tool for rotating it, the pawls in the sleeve being located in pairs, said pawls in each pair being coupled to each other, said pawls being installed on a single axle of rotation parallel to the central axis of the boring machine and being directed in different senses whereby one of said pawls in each pair is used for rotating said ratchet in one direction while another pawl is used to rotate it in the opposite direction, means for pressing the pawls to the ratchet made in the form of air power cylinders with pistons contacting the pawls, whereby a compressed air source is in communication with the air power cylinders of the pawls used to rotate said ratchet in one direction while the air power cylinders of the pawls used for rotating said ratchet in the opposite direction are in communication with the atmosphere, thus dropping them out of meshing with the ratchet.

According to the present invention an air percussion boring machine with a self-contained boring tool rotation has been made. Hence the boring tool rotation is intermittent and synchronous with the piston impacts. The intermittent rotation of the boring tool increases by 1.5–2 times the stability of boring bits when drilling strong and abrasive rocks while the presence of the reversing means and the air pressure of the pawls permits mechanization of auxiliary operations associated with assembling and disassembling the boring string of bars when drilling deep wells. In addition, the air pressure of the pawls permits the ommittance of the quickly wearable springs of the rotation mechanism, thus increasing the reliability of said rotation mechanism in operation. Since in the air percussion boring machine according to the invention the rotation machanism possesses an individual air pressure supply, its operation stability and efficiency are raised.

It is desirable that the rigid coupling of each pair of pawls should be performed by a lug made on one pawl and a responsive slot made on another pawl.

This coupling of the pawls is the most simple and reliable connection.

The boring machine according to one of the preferred embodiments of the present invention possesses an adaptor flange installed between the stator and the front head and provided with two holes one of the holes being in communication with the air power cylinders of the pawls used to rotate the ratchet in one direction via passages made in the splined sleeve while the other hole of the flange is insulated hermetically from the first hole and is in communication with the air power cylinders of the pawls used to rotate the ratchet in the opposite directions via a passage made in the sleeve, whereby each of the holes of the adaptor flange is in communication either with the air pressure source of with the atmosphere.

This system of air pressure supply to the air power cylinders presses the pawls of one direction of the rotation to the ratchet at a simultaneous separation of the pawls of the opposite direction of the rotation from the ratchet.

The specific features and advantages of the present invention will appear more completely from the following detailed description of a preferred embodiment thereof with due reference to the accompanying drawings wherein.

Figure 1:
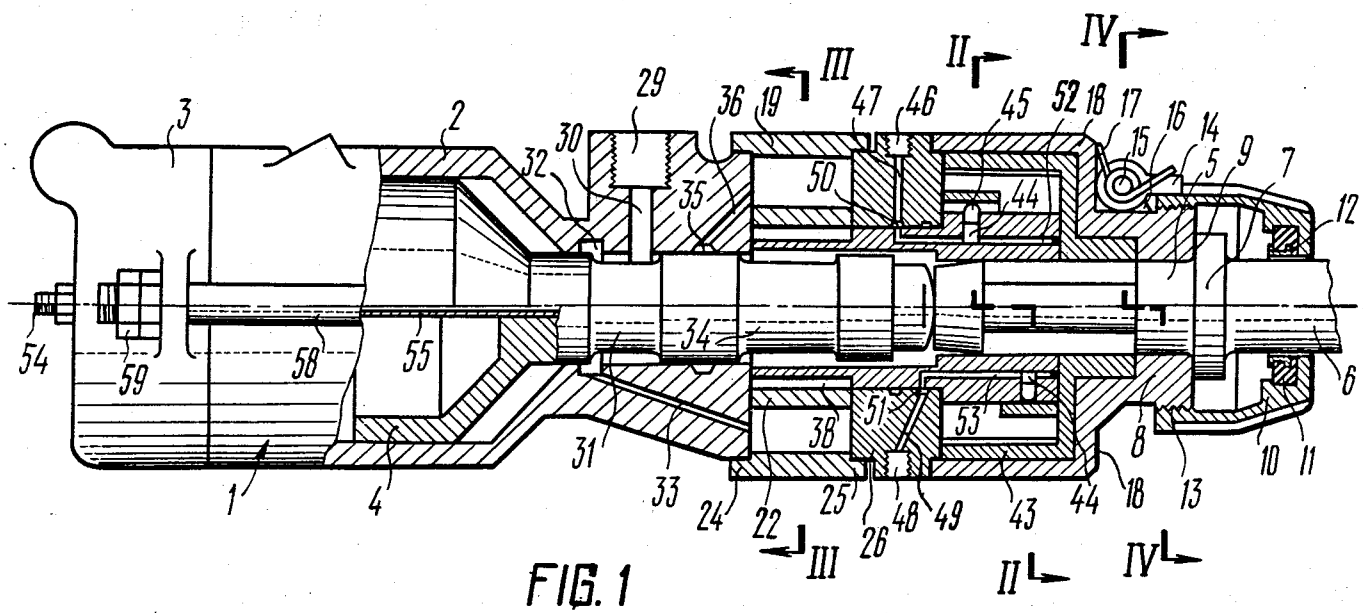
FIG. 1 shows an air percussion boring machine (longitudinal section) according to the invention.

According to the accompanying drawings the air percussion boring machine with a self-contained boring tool rotation comprises a percussion means 1 (FIG. 1) having a cylindrical housing 2 with a rear head 3 and an air distribution means built therein and containing a butterfly valve (not shown) intended for communicating the air pressure source via a system of air feed passages (not shown) in turn with operating and idle stroke chambers of the housing 2. For the purpose use can be made of another air distribution means of a similar effect. The housing 2 also accommodates a percussion piston 4 reciprocating under the effect of air pressure distributed by the air distribution means and delivering at the end of the power stroke impacts to the tail piece of the boring tool 5.

The tail piece of the boring tool 5 possesses a cylindrical surface 6 divided with a cylindrical fillet 7 into two parts, whereas one part enters the front head 8 whose end 9 supports the end of the fillet 7 while other part of the cylindrical surface 6 of the boring tool 5 enters the central hole of the boring tool holder 10.

Figure 4:
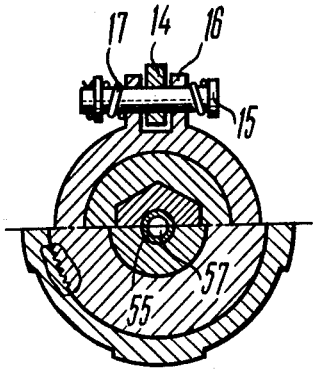
FIG. 4 is a section along the line IV—IV of FIG. 1.

The diameter of the fillet 7 exceeds that of the central holes of the front head 8 and of the boring tool holder 10 to prevent the tail piece of the boring tool 5 from dropping out of the boring machine and to provide optimum conditions when the percussion piston 4 delivers impacts to the tail piece of the boring tool 5. The face of the boring tool holder 10 is provided with a shock absorber 11 having a metal sleeve 12 which supports the fillet 7 of the tail piece of the boring tool when removing the boring tool from the well (not shown). Said boring tool holder 10 is secured on the front head 8 by a threaded joint 13 and a lock 14 installed on an axle 15 located in eyes 16 (FIG. 4). The axis of the lock 14 is perpendicular to the central axis of the boring machine. The lock 14 is inserted into the slot of the boring tool holder 10 and is pressed thereto by a spring 17. The spring 17 is coiled about an axle 15 in such a way that both ends thereof rest on an end 18 of the front head 8.

Figure 3:
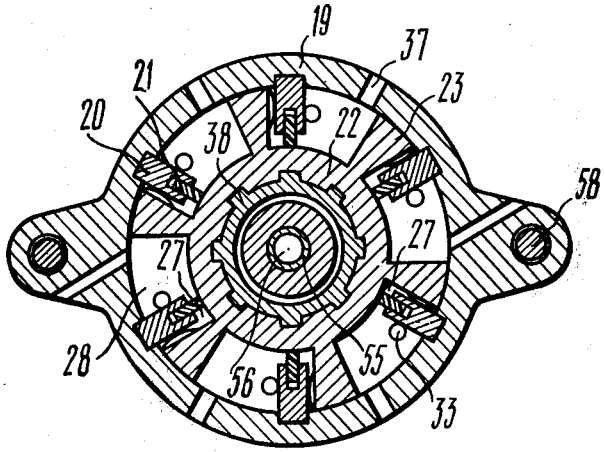
FIG. 3 is a section along the line III—III of FIG. 1.

The rotation mechanism is installed between the housing 2 and the front head 8 and comprises a fixed cylindrical stator 19 (FIG. 3) with blades 20 secured on its internal surface equidistant from each other and having sealing members 21 (FIG. 3) at the ends. Sealing members 21 can be made of a nonmetallic material having antifriction properties. Installed inside the stator 19 is a rotor 22 having on its external surface blades 23 whose number is equal to the number of the blades 20 of the stator 19 and the distance between them is equal to the distance between the blades of the stator 19. The height of the stator 19 blades 20 and the rotor 22 blades 23 is selected in such a way that the tips of the blades 23 of the rotor 22 adjoint tightly the internal cylindrical surface of the stator 19 while the sealing members 21 of the tops of the stator blades 20 adjoin tightly the cylindrical surface of the rotor 22. At its end faces the stator 19 is provided with annular lugs 24 and 25 (FIG. 1) whereby the stator 19 is centered with respect to the central axis of the boring machine and adjoins tightly the end faces of the cylindrical housing 2 and the adaptor flange 26 which is also in the rotation mechanism. Hence, the end faces of the stator blades 20 adjoin fully the end faces of the housing 2 and the adaptor flange 26, while the end faces of the rotor blades 23 adjoin tightly the end faces of the cylindrical housing 2 and the adaptor flange 26, thus allowing for an oscillatory motion of the rotor 22 in the stator 19. A number of rotor blades 23 and stator blades 20 is selected to provide a necessary torque and an angle of turn of the boring tool for each cycle of the boring machine operation (i.e. for forward and backward strokes of the percussion piston 4). Each rotor 22 blade 23 divides a cavity defined by two adjacent stator 19 blades 20 into two chambers: an operating stroke chamber 27 and an idle stroke chamber 28. The operating stroke chamber 27 and the idle stroke chamber 28 are alternated in communication with the air pressure source (not shown).

The compressed air is supplied to said chambers 27 and 28 via holes 29 and 30 made in the housing 2 whereby at the end of the forward stroke of the percussion piston 4 the holes 29 and 30 via an annular groove 31 of the percussion piston 4, annular recess 32 and passages 33 of the housing 2 are in communication with the chambers 28 of the rotation mechanism. At the end of the backward stroke of the percussion piston 4 the holes 29 and 30 of the cylindrical housing 2 via a groove 34 of the percussion piston 4, annular recess 35 of the cylindrical housing 2 and passages 36 are in communication with the chambers 27 of the rotation mechanism.

Air tightness of the air supply passages 30 and 33 to the chambers 27 and 28 of the rotation mechanism is provided by a cylindrical surface of the housing 2 and an external surface of the rod of the percussion piston 4 being in conjunction with each other by a running fit.

Figure 5:
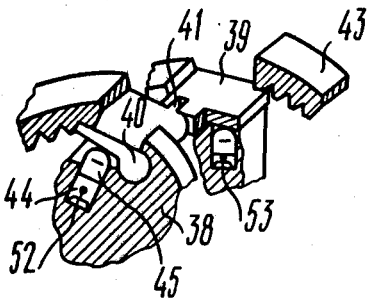
FIG. 5 shows a kinematic circuit of a pair of pawls according to the invention.
Figure 6:
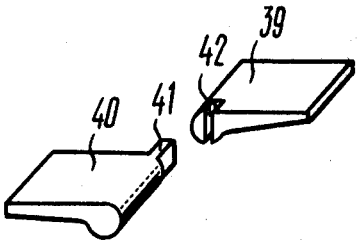
FIG. 6 shows an embodiment of a coupling of the pair of pawls.

The used air from the chambers 27 and 28 is exhausted to the atmosphere via holes made between the adjacent stator blades 20. Installed inside the hollow rotor 22 is a splined sleeve 38 wherein pawls 39 and 40 are hinged by pairs. Each pair of pawls contains pawls 39 and 40 coupled to each other, directed in different senses and arranged on a single axle of rotation parallel to the central axis of the boring machine, the rigid coupling of each pair of pawls 39 and 40 being performed by a lug 41 (FIGS. 5 and 6) made on the pawl 40 and a responsive slot 42 made on the pawl 39. This coupling between the pawls 39 and 40 in each pair provides a meshing of the pawl 39 or 40 with the ratchet 43 installed in the front head 8 and coupled to the tail piece of the boring tool 5 whereas the pawls used for rotating the ratchet 43 in the opposite direction are not in contact with the ratchet 43.

Each pawl 39 or 40 is provided with a means for pressing same to the ratchet 43. This means is made in the form of a hole in the splined sleeve 38 used as an air power cylinder 44. The piston 45 installed in the air power cylinder 44 is in contact with the pawl 39 or 40.

For feeding the compressed air to the air power cylinders 44 and for exhausting the used air the adaptor flange 26 is provided with holes 46 and 47 and 48 and 49 insulated hermetically from each other and having annular recesses 50 and 51 respectively. Each annular recess 50 or 51 is in communication with the respective air power cylinders 44 of the pawls 39 and 40 via the passages 52 and 53 made in the splined sleeve 38.

The boring machine according to the invention is provided with a means (not shown) for connecting an air pressure self-contained source via the holes 46 and 48 in the adaptor flange 26 to the air power cylinders 44 of the pawls 39 or 40 so that when the air power cylinders 44 of the pawls of one direction of rotation of the boring tool are coupled to said air pressure source, the air power cylinders 44 of the pawls of the opposite direction of rotation are communicated with the atmosphere.

Figure 2:
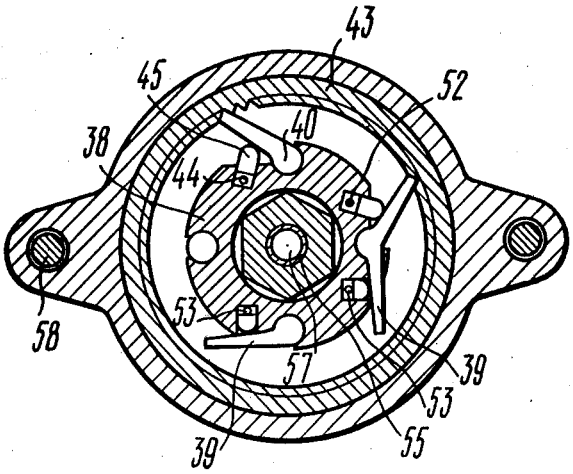
FIG. 2 is a section along the line II—II of FIG. 1.

For removing the drilling slime from the hole mouth, as well as for suppressing boring dust, the air percussion boring machine according to the invention is provided with a means for supplying liquid or air-water mixture to the face. Said means comprises a pipe branch 54 installed in the end of the rear head 3 and a pipe 55 connected thereto and passing through the central holes 56 and 57 (FIGS. 2 and 3) of the percussion piston 4 and the tail piece of the boring tool 5 respectively. Said pipe 55 is insulated hermetically with a corresponding packing (not shown) which is in the front head 8 and in the hole of the tail piece of the boring tool 5.

Percussion means 1, rotation mechanism, front 8 and rear 9 heads are fastened to each other with coupling bolts 58 and nuts 59. When setting the boring machine into operation the air pressure source is connected simultaneously to the percussion means 1 via a hole (not shown) in the rear head 3, to the mechanism for rotating the boring tool 5 via the hole 29 in the housing 2 and to the air power cylinders 44 via holes 46 and 48 of the adaptor flange 36. The compressed air from the rear head 3 is fed into the air distribution means (not shown) which is alternated in supplying the air to the operating stroke chamber and idle stroke chamber of the percusion means 1. Under the effect of the compressed air the percussion piston 4 reciprocates and at the end of the power stroke delivers impacts to the tail piece of the boring tool 5. The used air from the operating stroke chamber and idle stroke chamber of the percussion 1 via an exhaust hole (not shown) is withdrawn to the atmosphere.

A percussion load from the tail piece through the boring tool is imparted to the face of the well. In addition, when moving the percussion piston 4, the recesses 31 and 34 located on its rod portion at the end of the forward stroke permit the flow of compressed air from the air pressure source via an annular recess 32 and passages 33 in the housing 2 to the chambers 28 of the rotation mechanism. Under the effect of the compressed air the rotor 22 rotates clockwise, thus driving the splined sleeve 38 coupled thereto. At the same time the air pressure source is coupled to the hole 46 of the flange 26. Therefrom the air is fed into the annular groove 50 connected with passages 52 of the splined sleeve 38 and is fed to the air power cylinders 44 of the pawls 40. Under the effect of the compressed air the pistons 45 installed in the air power cylinders 44 press the pawls 40 to the ratchet 43, thus meshing the pawls 40 with the ratchet 43. At the same time the air from the air power cylinders 44 of the pawls 39 via the passages 53 of the splined sleeve 38, annular groove 51 and holes 49 and 48 of the adapter flange 26 is exhausted to the atmosphere. The pawls 40 coupled to the pawls 39 are dropped out of meshing with the ratchet 43.

When rotating clockwise said splined sleeve 38 provides a condition wherein the pawls 40 slide on teeth of the ratchet 43 without driving the latter and the tail piece of the boring tool 5 associated therewith.

Thus, an idle rotation of the rotation mechanism of the boring tool 5 is performed. At the end of the backward stroke of the percussion piston 4 the recess 34 made on its rod surface communicates the holes 29 and 30 via the annular recess 35 and passages 36 of the housing with the chambers 27 of the mechanism for rotating the boring tool 5. Under the effect of the compressed air the rotor 22 and the splined sleeve 38 coupled thereto rotate counterclockwise. The ends of the pawls 40 actuate the ratchet 43, thus rotating, also counterclockwise, said ratchet and the tail piece of the boring tool 5 associated therewith. Thus, at the end of the forward stroke of the percussion piston 4 an idle turn of the mechanism for rotating the boring tool 5 is performed while at the end of the backward stroke of the percussion piston 4 an operating turn of the mechanism for rotating the boring tool 5 is carried out. This provides a synchronous operation of the rotation mechanism and the percussion means 1.

For rotating the tail piece of the boring tool 5 clockwise the air pressure source is connected to the hole 48 of the flange 26 which via the hole 49 and the annular recess 51 is in a communication with passages 53 of the splined sleeve 38 which is in communication with the air power cylinders 44 of the pawls 39. Under the efect of the compressed air the pistons 45 press the pawls 39 to the ratchet 43 and provide their constant meshing with the latter. The pawls 40 coupled to the pawls 39 are dropped out of meshing with the ratchet 43. The air power cylinders 44 of the pawls 40 via the passages 52 of the splined sleeve 38 are in communication via the annular recess 50 and the holes 46 and 47 of the adaptor flange 26 with the atmosphere. When the pawls 39 and 40 are at the end of the forward stroke of the percussion piston 4, the rotor 22 and the splined sleeve 38 coupled thereto rotate clockwise while the pawls 39 actuate the ratchet 43, thus rotating same and the tail piece of the boring tool 5 associated therewith, also clockwise.

At the end of the backward stroke of the percussion piston 4 when the rotor 22 under the effect of the compressed air rotates counterclockwise with the splined sleeve 38 coupled thereto, the pawls 39 slide on the ratchet 43 without driving same and the tail piece of the boring tool 5 associated therewith. Thus, at the end of the forward stroke of the percussion piston 4 the mechanism for rotating the boring tool 5 performs a turn clockwise but at the end of the backward stroke of the percussion piston 4 it performs an idle turn. This provides a synchronous operation of the mechanism for rotating the boring tool 5 and the percussion means 1.

When drilling for suppression of boring dust and for removal of the boring slime to the hole mouth liquid or air-water mixture is supplied via pipe branch 54 and central pipe 55 sealed respectively and passing through the central hole 56 of the percussion piston 4 and the central hole of the tail piece of the boring tool 5.

When drilling, the fillet 7 of the tail piece of the boring tool 5 rests on the end 9 of the front head 8 while when removing the boring tool from the well, the sleeve 12 of the boring tool holder 10 supports said fillet 7, thus retaining the tail piece of the boring tool 5 in the boring machine.

What we claim is:

1. An air percussion boring machine comprising: percussion means having a hollow cylindrical housing; a rear head having air distribution means disposed within said housing; a percussion piston located inside said housing for reciprocating under the effect of compressed air and for delivering impacts at the end of the power stroke to a tail piece of the boring tool; a front head disposed coaxially with respect to said percussion piston and said tail piece of the boring tool; a boring tool holder connected to said front head and having a central hole for permitting said boring tool to extend axially outwardly therefrom; a boring tool rotation mechanism, installed in the front portion of the boring machine, having a stator with a plurality of stator blades secured on its internal surface equidistant from each other, a rotor installed inside said stator and provided with a plurality of rotor blades whose number is equal to that of said stator blades, a sleeve installed inside said rotor, a ratchet installed in said front head and coupled to the tail piece of said boring tool for rotating same, at least one pair of hinged pawls in said sleeve, said pawls of each of said pair of pawls being coupled to each other, and said pawls having a common axle of rotation parallel to the central axis of the boring machine and directed in different senses whereby one of the pawls in each pair is used to rotate said ratchet in one direction whereas the other pawl in each pair is used to rotate said ratchet in an opposite direction, each of said pairs of pawls comprising a rigid coupling in the form of a lug provided on one pawl and a mutually cooperatively associated slot provided on the other pawl; means for urging said pawls to said ratchet comprising air power cylinders with pistons contacting said pawls; and an air pressure source in communication with a first group of air power cylinders designed to rotate said ratchet in one direction when said pawls are in mesh with said ratchet, while a second group of air power cylinders designed to rotate said ratchet in an opposite direction is in communication with the atmosphere.

2. An air percussion boring machine comprising: percussion means having a hollow cylindrical housing; a rear head having air distribution means disposed within said housing; a percussion piston located inside said housing for reciprocating under the effect of compressed air and for delivering impacts at the end of the power stroke to a tail piece of the boring tool; a front head disposed coaxially with respect to said percussion piston and said tail piece of the boring tool; a boring tool holder connected to said front head and having a central hole for permitting said boring tool to extend axially outwardly therefrom; a boring tool rotation mechanism, installed in the front portion of the boring machine, having a stator with a plurality of stator blades secured on its internal surface equidistant from each other, a rotor installed inside said stator and provided with a plurality of rotor whose number is equal to that of said stator blades, a sleeve installed inside said rotor, a ratchet installed in said front head and coupled to the tail piece of said boring tool for rotating same, at least one pair of hinged pawls in said sleeve, said pawls of each of said pair of pawls being coupled to each other, and said pawls having a common axle of rotation parallel to the central axis of the boring machine and directed in different senses whereby one of the pawls in each pair is used to rotate said ratchet in one direction whereas the other pawl in each pair is used to rotate said ratchet in an opposite direction; means for urging said pawls to said ratchet comprising air power cylinders with pistons contacting said pawls; an air pressure source in communication with a first group of air power cylinders designed to rotate said ratchet in one direction when said pawls are in mesh with said ratchet, while a second group of air power cylinders designed to rotate said ratchet in an opposite direction is in communication with the atmosphere; and an adapter flange provided between said stator and the front head and being provided with two holes, a first of said holes being in communication with said first group of air power cylinders for rotating the ratchet in one direction via first passages provided in said sleeve, and a second of said holes being in communication with the second group of air power cylinders for rotating the ratchet in the opposite direction via second passages provided in the sleeve, whereby each of said holes of the adaptor flange is in communication either with the air pressure source or with the atmosphere.

3. An air percussion boring machine as claimed in claim 2, wherein said pawls of each of said pair of pawls are mechanically coupled to each other.

4. An air percussion boring machine as claimed in claim 2, wherein said pawls of each of said pair of pawls are mechanically coupled to each other.

* * * * *